US012520978B2

(12) United States Patent
Yang

(10) Patent No.: US 12,520,978 B2
(45) Date of Patent: Jan. 13, 2026

(54) AIR FLOW CHANNEL SWITCHING STRUCTURE

(71) Applicant: Yong Yang, Hunan (CN)

(72) Inventor: Yong Yang, Hunan (CN)

( * ) Notice: Subject to any disclaimer, the term of this patent is extended or adjusted under 35 U.S.C. 154(b) by 344 days.

(21) Appl. No.: 18/138,135

(22) Filed: Apr. 24, 2023

(65) Prior Publication Data

US 2023/0255419 A1 Aug. 17, 2023

(51) Int. Cl.
*A47L 9/24* (2006.01)
*A47L 5/14* (2006.01)

(52) U.S. Cl.
CPC ..... *A47L 9/242* (2013.01); *A47L 5/14* (2013.01)

(58) Field of Classification Search
CPC . A47L 5/14; A47L 9/242; A47L 9/248; A47L 9/244; A47L 5/225; A47L 5/24
See application file for complete search history.

(56) References Cited

U.S. PATENT DOCUMENTS

2009/0241285 A1* 10/2009 Hinklin ..... A47L 5/225 15/330

* cited by examiner

*Primary Examiner* — Andrew A Horton
(74) *Attorney, Agent, or Firm* — JEEN IP LAW, LLC

(57) ABSTRACT

An air flow channel switching apparatus includes a housing. A front end of the housing is provided with air inlet and outlet. An interior of the housing is provided with a blower assembly and an vacuum assembly. One sides of the blower assembly and the vacuum assembly are provided with at least one group of air duct switching assembly. The air duct switching assembly includes a mounting bracket, a pipe connector, a flexible hose, and a rotating assembly.

10 Claims, 8 Drawing Sheets

AIR FLOW CHANNEL SWITCHING STRUCTURE

FIELD OF THE INVENTION

The invention relates to air blowing and suction integrated device and more particularly to an air flow channel switching structure of the air blowing and suction all-in-one device.

BACKGROUND OF THE INVENTION

An device integrating air blowing and suction relates to two technologies of air blowing and suction. In the air blowing technology, a mechanism capable of generating wind power is required, and air flow is usually generated by rotating a motor, and the air flow is blown to a place needing air blowing through an air nozzle. Suction technology requires a mechanism that generates a negative pressure, usually through a rotating impeller, that draws air and dust into the dust bin.

At present, there is a vacuum cleaner with a comb on the market, which can be used for combing pet hair and suction the fallen hair into the dust bin of vacuum cleaner. While this appliance can solve the problem of storing lost hair during grooming, it cannot blow dry the hair.

However, similar appliance existing on the market include pet hair dryer, blow dryer and vacuum cleaners. hair dryer can be used for drying human or animal hair, but cannot rapidly switch vacuum cleaner, and vacuum cleaners can be used for cleaning hairs on floors and furniture, but cannot dry hair of people or animals. The pet blow dryer is mainly used for professional pet markets or families raising large pets. The pet hair dryer is large, although the wind is strong, it does not have the ability to quickly switch between blowing and suction on the same device, which needs to be improved.

SUMMARY OF THE INVENTION

In order to overcome the above disadvantages of the prior art, an embodiment of the invention provides an air flow channel switching structure of a blowing and suction integrated device to solve the problems in the background technology.

To achieve the purpose, the invention provides the following technical scheme: the air flow channel switching structure of the air blowing and suction integrated device comprises a device, wherein the device comprises a housing, and the front end of the housing is provided with an air inlet and outlet;

- a blower assembly and a vacuum assembly are arranged in the housing, and at least one group of air duct switching assembly are arranged at one side of the blower assembly and the vacuum assembly;
- the air duct switching assembly comprises a mounting bracket, a pipe connector, a flexible hose and a rotating assembly;
- the interior mounting bracket is provided with a cavity, and the bottom of the cavity is provided with a group or groups of air inlet connection port and air outlet connection port. The top of the cavity is provided with a hole, which hole extends to the bottom of the cavity of the air inlet connection port and the air outlet connection port opposite two sides. The air outlet of the air blower assembly is transferred with the air outlet connecting port on the air duct switching assembly through the pipe connector. The air inlet of the vacuum assembly is transferred with the air inlet connecting port on the air duct switching assembly through the pipe connector;
- the pipe connector is arranged in the cavity on the mounting bracket in a sliding way, and the pipe connector is matched with the cavity;
- the pipe connector comprises a base plate arranged below, wherein the outer wall of the shell of the base plate is sleeved with an a spring, an circular cover plate is arranged above the spring, the circular cover plate is sleeved on the base plate;
- the two side edges of the base plate are provided with a convex platforms which extends out of the outer wall of the cavity;
- the rotating assembly comprises a control handle arranged at one side. The control handle penetrates through the housing and is rotatably connected with the housing. A u-shaped bracket is arranged on the inner side of the control handle, limiting sliding holes are formed in two side walls of an opening of the u-shaped bracket. The rotating assembly is movably connected with a pipe connector through the limiting sliding hole and a convex platforms;
- the flexible hose is arranged at one side of the pipe connector. One end of the flexible hose is in adaptive connection with the pipe connector, and the other end of the flexible hose passes through a hole at the top of the cavity and is matched and butted with the air inlet and the outlet. The air inlet and outlet are externally connected with the hose;
- by twisting the control handle on the rotating assembly upward or downward, the u-shaped bracket rotates upward or downward and connects the pipe connector at the same time. When the pipe connector moves to the air outlet connection port on the air duct switching assembly, the flexible hose is connected to the air outlet of the air blower assembly, which shows the blowing mode. If the pipe connector moves to the air inlet connection port on the air duct switching assembly, the flexible hose is connected with the air inlet of the vacuum assembly. This is the suction mode, the device's blowing mode and suction mode are very easy to operate, and the structure is simple.

In one prefer embodiment, an annular groove is arranged on that bottom surface part in the cavity, at the opening of the air inlet connection port and at the opening of the air outlet connection port. A adaptive elastic rubber pad can be arrange in the annular groove.

In a preferred embodiment, the bottom base plate is provided with an annular arc convex platforms which is matched with the annular groove in the cavity. If the base plate slides to the air inlet connecting port or the air outlet connecting port, the annular arc convex platforms is firmly clamped in the annular groove under the elastic force of the spring, so that the connection dislocation of the linkage pipe connector is effectively prevented, and the blowing or suction effect of the device is influenced. The bottom surface of the base plate may also be planar or curved.

In a preferred embodiment, two opposite side walls of the mounting bracket are provided with one or more groups of chute, and the chute on the mounting bracket are matched with the convex platforms on the base plate.

In a preferred embodiment, that bottom surface within the cavity may also be planar or curved and adapt to the bottom surface in contact with the pipe connector.

In a preferred embodiment, one side surface of the u-shaped bracket is provided with a contact piece and a contact piece. And, the contact piece is arranged at one side of the contact piece.

In a preferred embodiment, a corresponding trigger device is arranged above a contact piece on the u-shaped bracket. The trigger device is fixed on the housing through a screw or a buckle.

In a preferred embodiment, the device also includes a circuit board and a driver circuit adapted to the circuit board. The circuit board is mounted on an internal side of the housing.

In a preferred embodiment, the blower assembly comprises a motor assembly and an electric heating wire mounted on an inner side of the blower assembly housing. The motor assembly, electric heating wire, trigger device are electrically connected with the circuit board. Twist the control handle downward, and the u-shaped bracket linkage pipe connector on the control handle moves downward. When the annular arc convex platforms on the bottom face of the base plate of the pipe connector is stuck into the annular groove below the cavity, the contact piece on the u-shaped bracket contacts with the trigger device. Turn on the corresponding switch button on the device, and motor assembly in the blower assembly works with the electric heating wire. The blower assembly blows outward.

In a preferred embodiment, the vacuum assembly also includes a motor assembly mounted on an internal side of the vacuum assembly housing and a strainer tank mounted in front of the motor assembly. The motor assembly, trigger device is electrically connected with the circuit board. Twist the control handle upward, u-shaped bracket linkage pipe connector on the control handle rotates upward. When the annular arc convex platforms on the bottom base plate of the pipe connector is stuck into the annular groove on the upper inner part, the contact plate on the u-shaped bracket is in contact with the trigger device. Turn on the corresponding switch button on the device, and the motor assembly in the vacuum assembly is powered on. The vacuum assembly draws air inward.

Following are technical effects and advantages of the invention: by setting the air duct switching assembly composed of flexible hose, rotating assembly, pipe connector and mounting bracket, in use, only need to twist the control handle on the rotating assembly, control handle u-shaped bracket linkage pipe connector, pipe connector sliding up and down or left and right in the cavity of the mounting bracket. The flexible hose fixed at one end of the pipe connector is switched to the corresponding air inlet or outlet pipe to realize the blowing and suction of the device. The device is multi-functional and has a relatively simple structure, with small size, which convenient for users.

The above and other objects, features and advantages of the invention will become apparent from the following detailed description taken with the accompanying drawings.

DETAILED DESCRIPTION OF THE INVENTION

Figure 1:
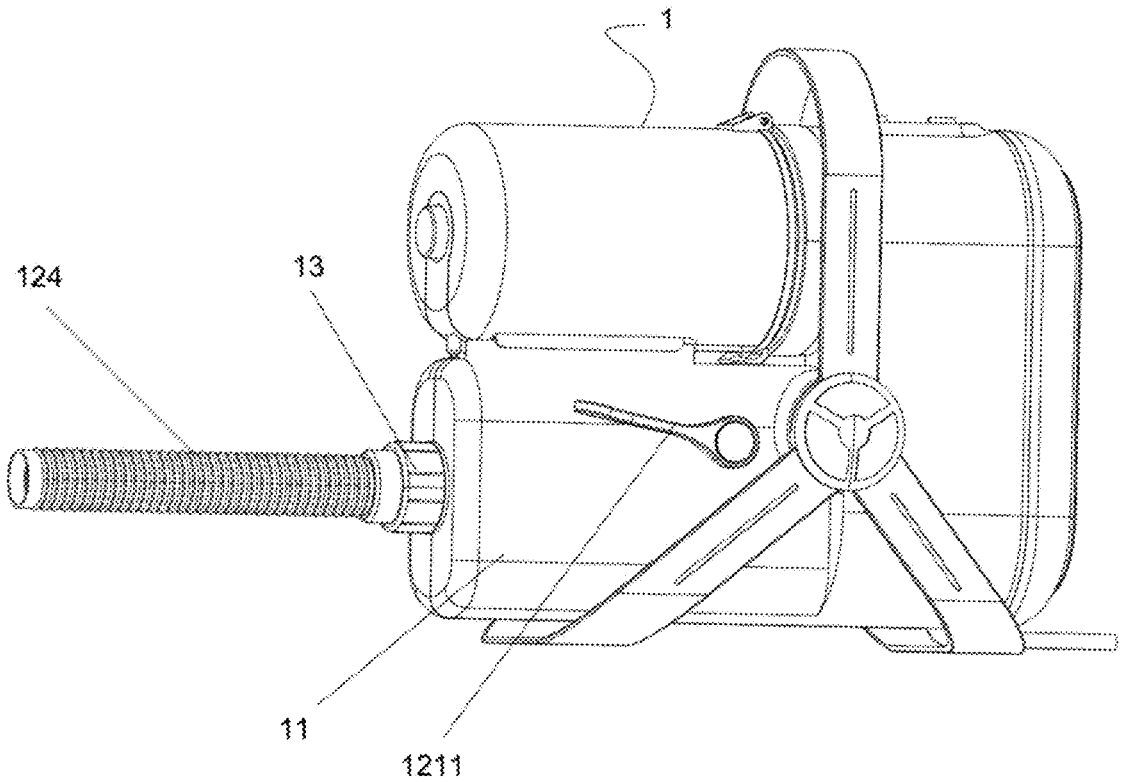
FIG. 1 is a perspective view of an air flow channel switching structure of the invention.
Figure 2:
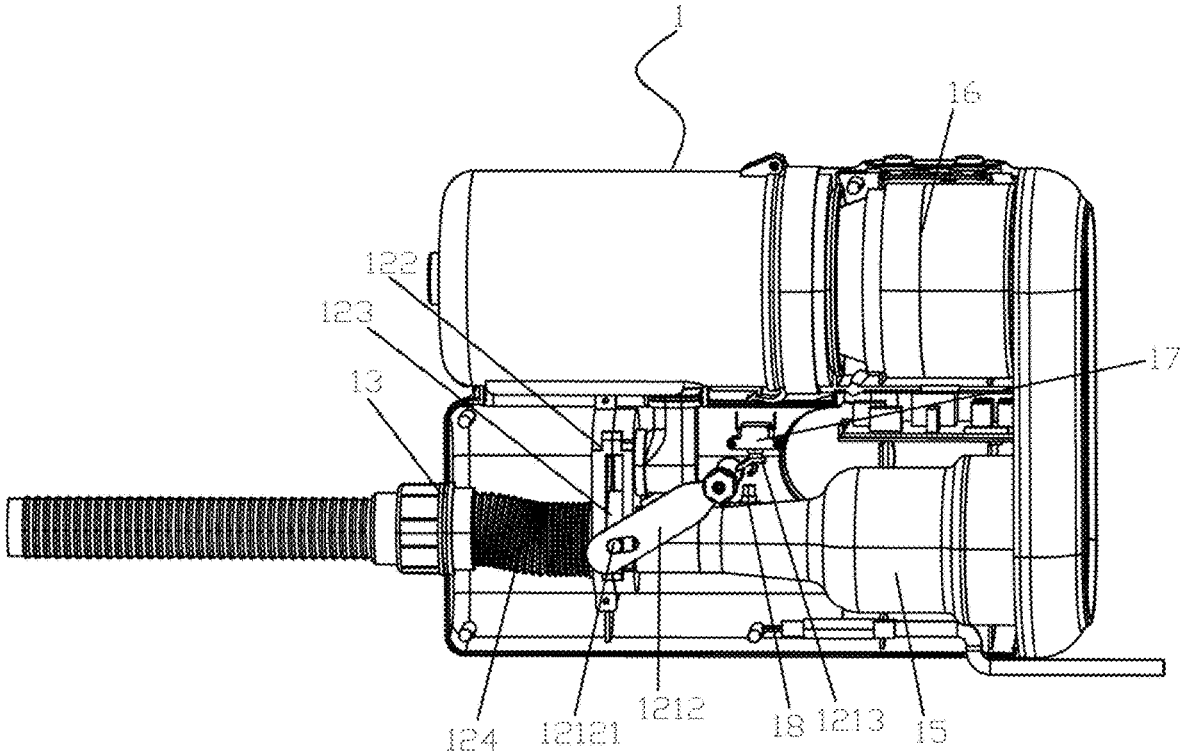
FIG. 2 is a perspective view showing internal characteristics of the air flow channel switching structure when blowing.
Figure 3:
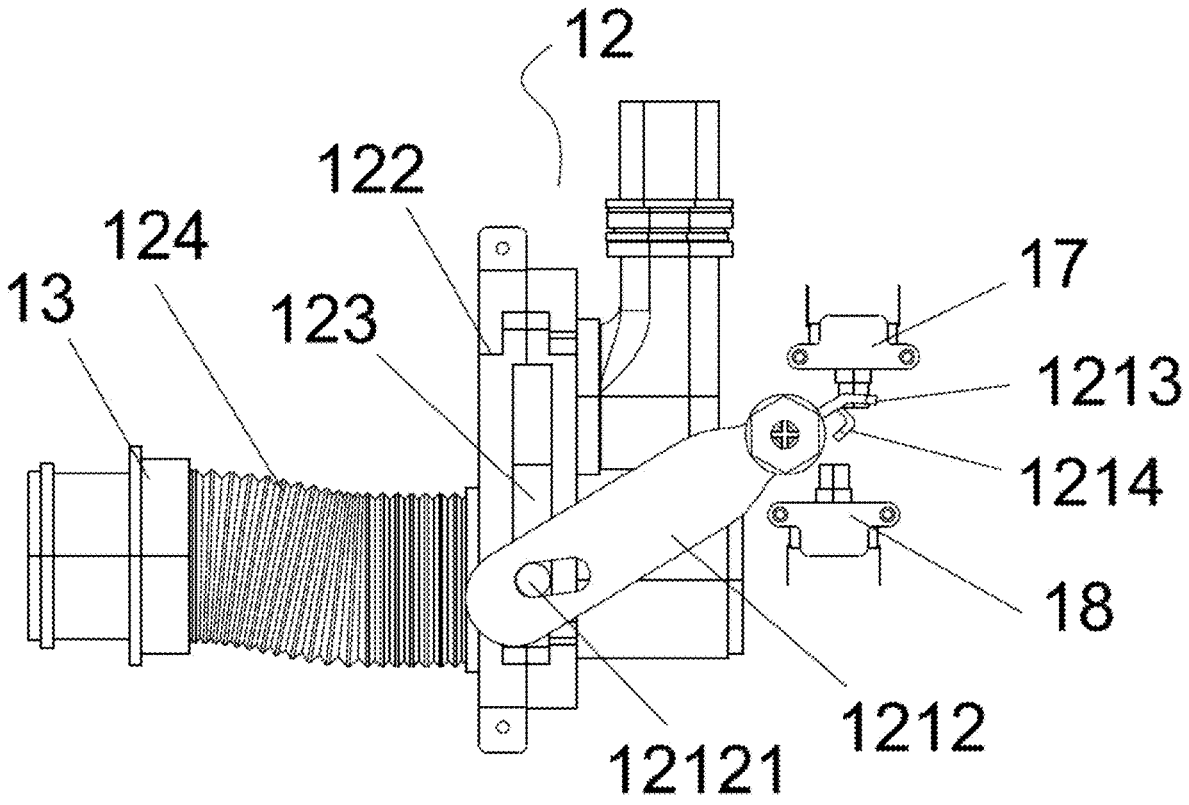
FIG. 3 is a perspective view showing the air duct switching assembly when blowing in FIG. 2.
Figure 4:
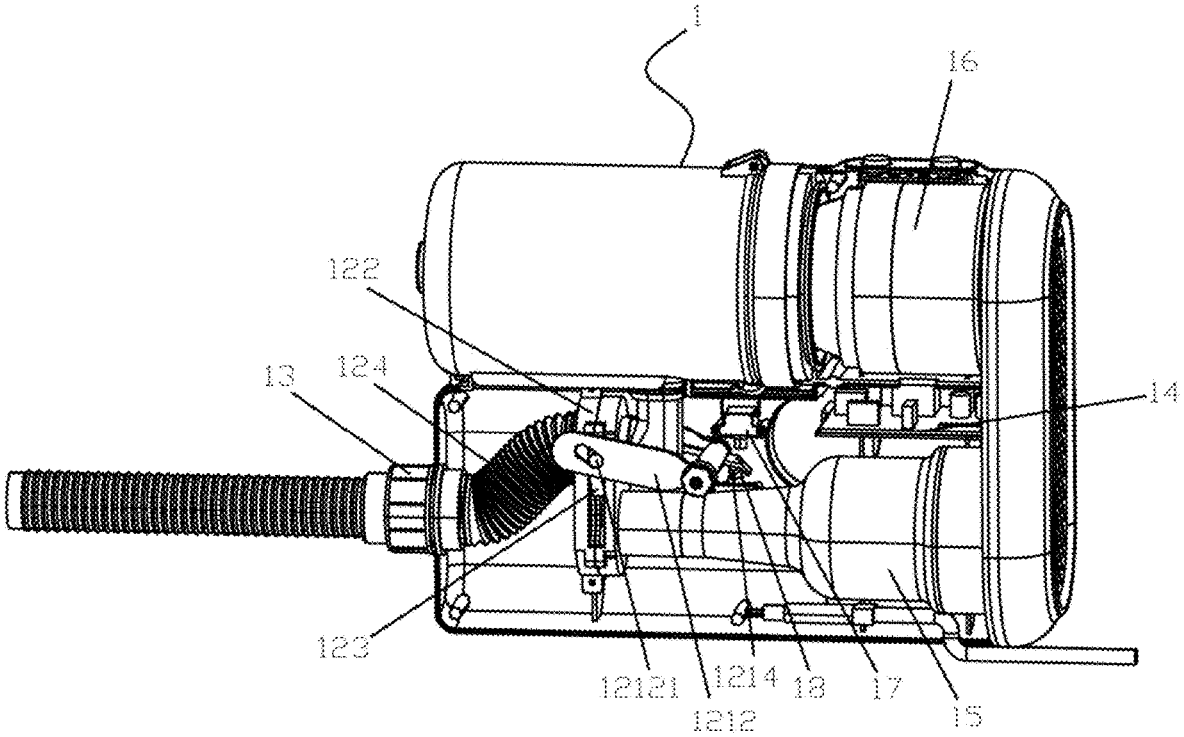
FIG. 4 is a view similar to FIG. 2 showing the invention when suctioning.
Figure 5:
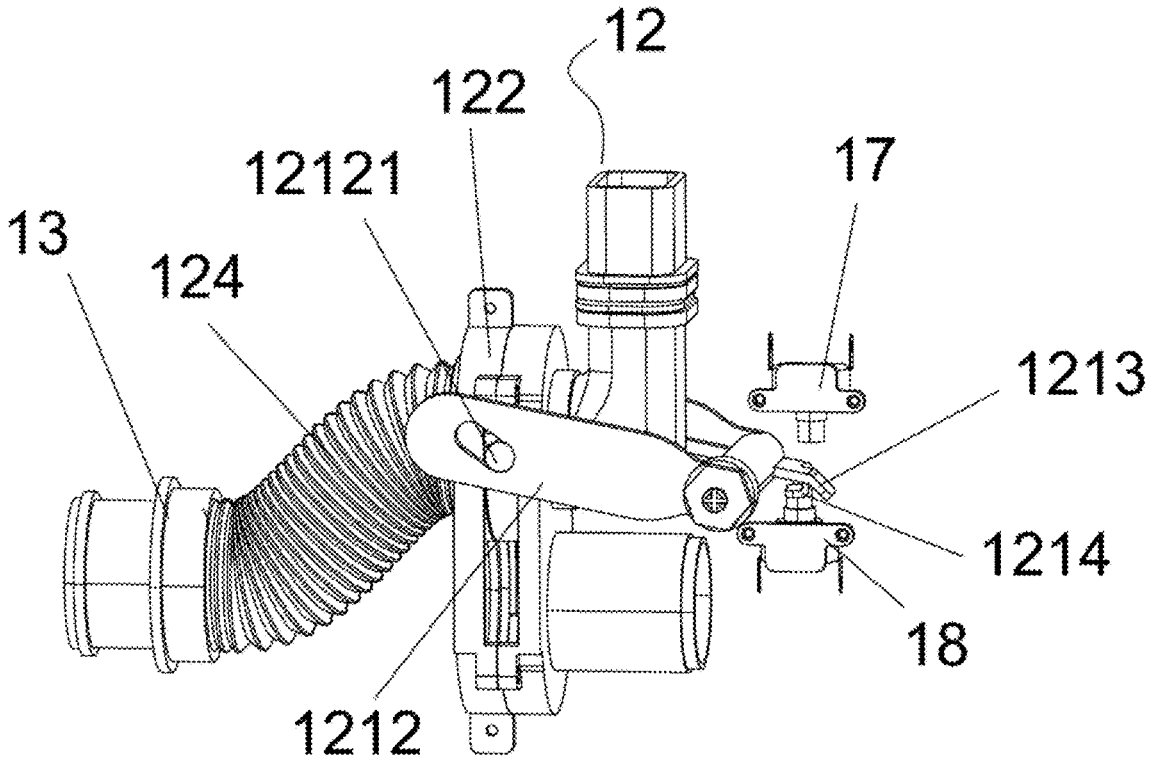
FIG. 5 is a perspective view showing the air duct switching assembly when suctioning in FIG. 4.
Figure 6:
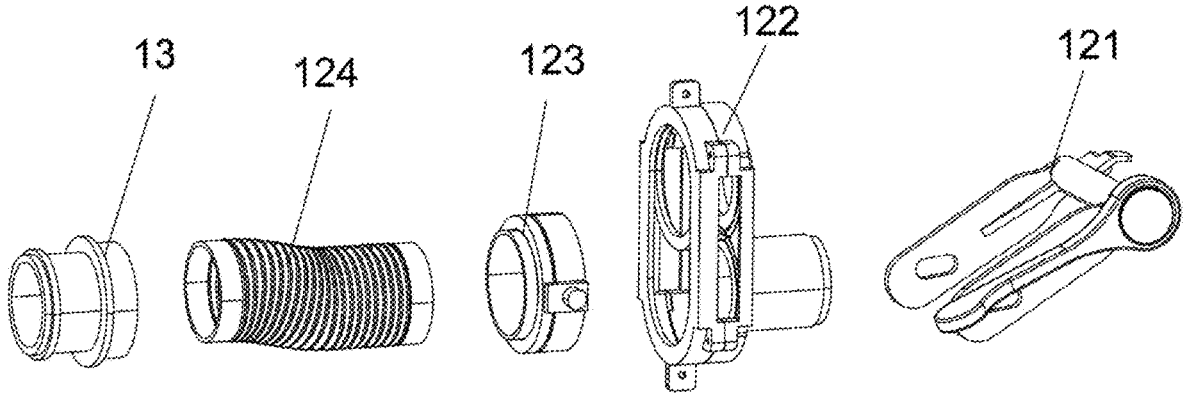
FIG. 6 is an exploded view of the air duct switching assembly.
Figure 7:
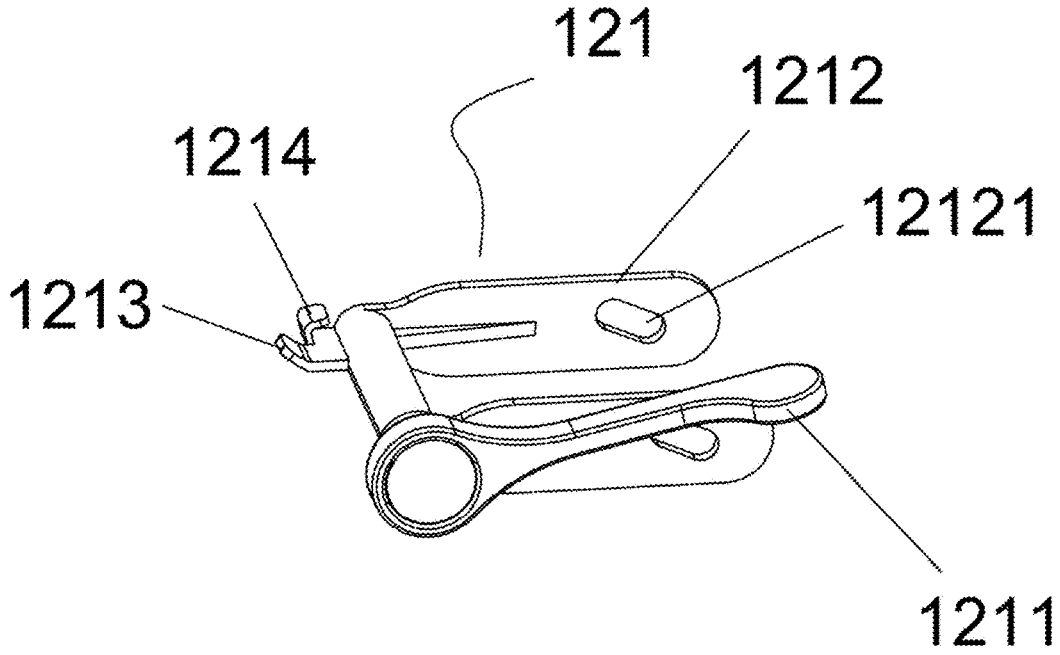
FIG. 7 is a perspective view of the rotating assembly.
Figure 8:
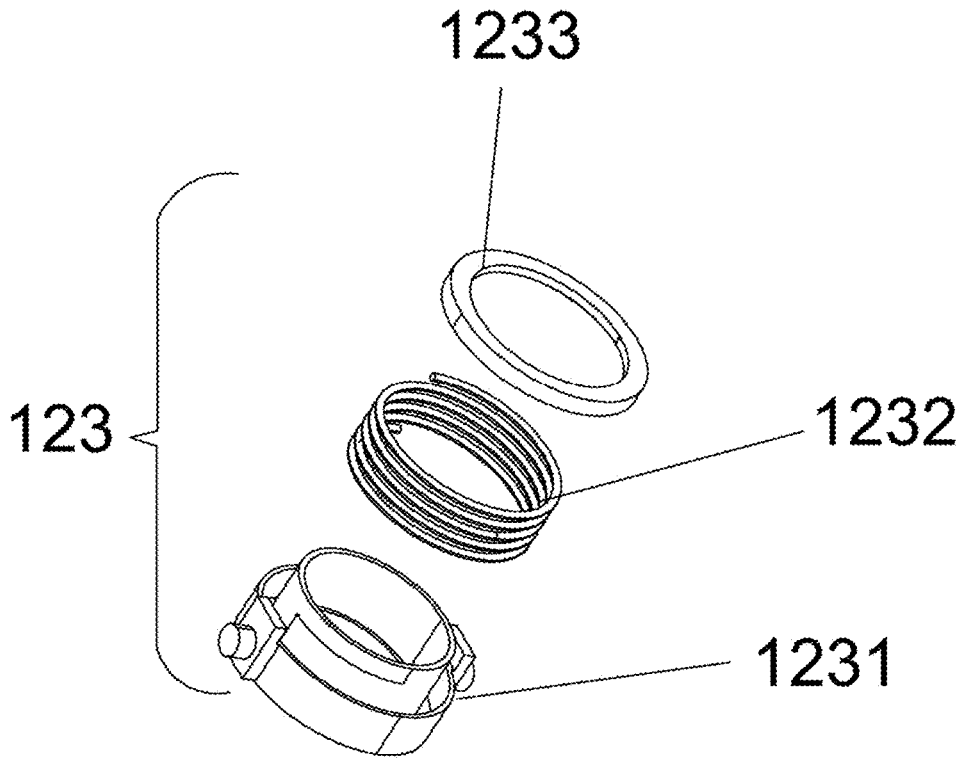
FIG. 8 is an exploded view of the pipe connector.
Figure 9:
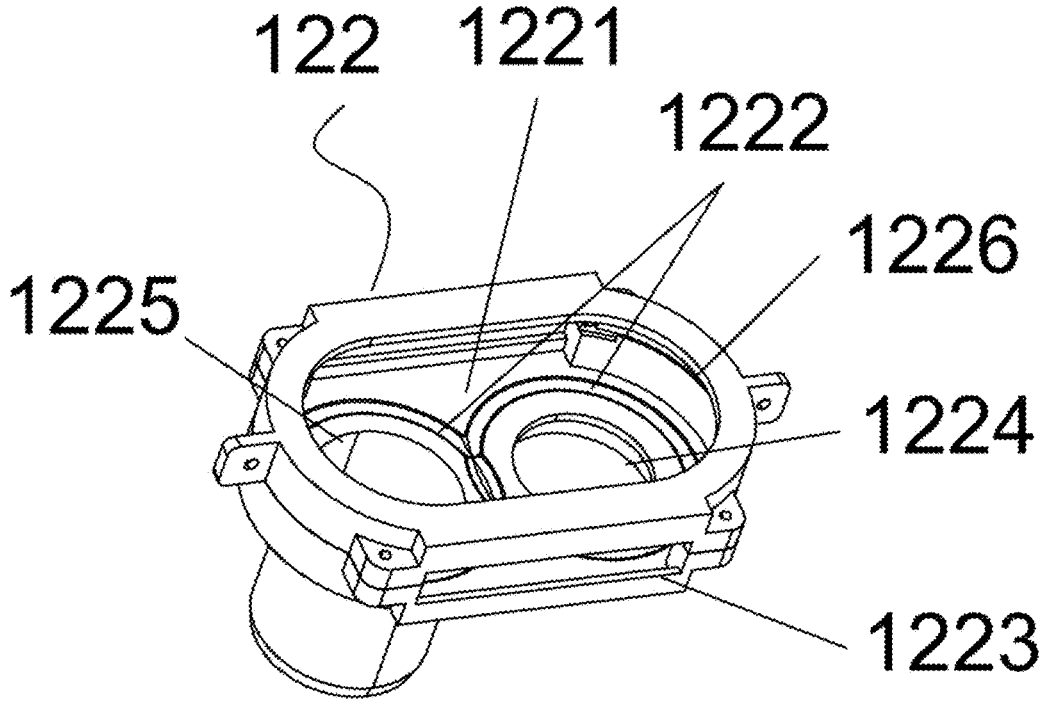
FIG. 9 is a perspective view of the mounting bracket.
Figure 10:
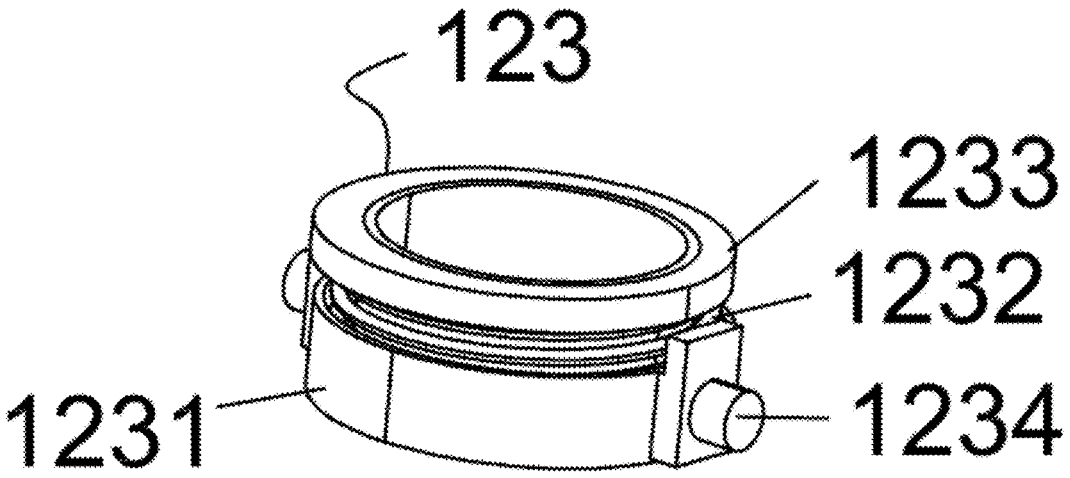
FIG. 10 is a perspective view of the pipe connector.
Figure 11:
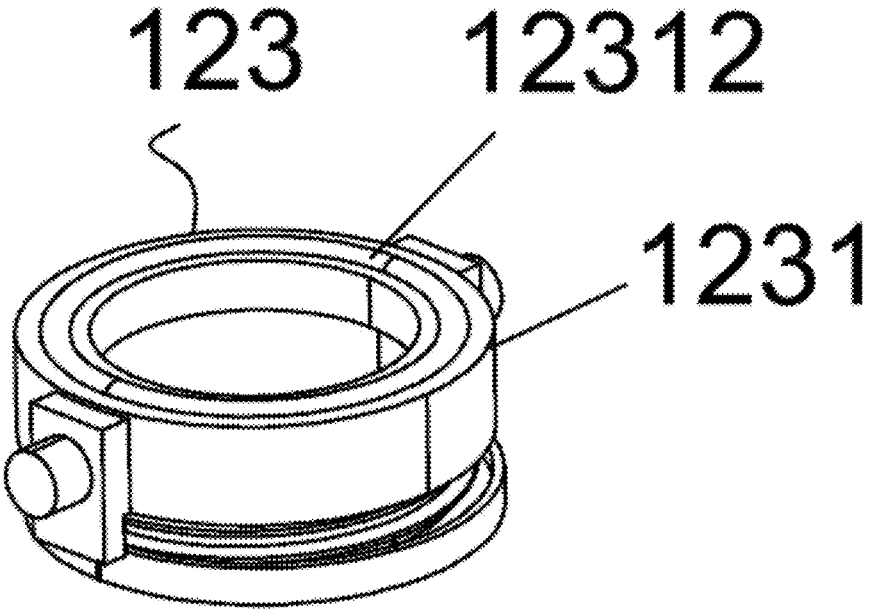
FIG. 11 is another perspective view of the pipe connector.

Referring to FIGS. 1 to 11, an air flow channel switching structure in accordance with the invention comprises a device 1. The device 1 comprises a housing 11. The front end of the housing 11 is provided with an air inlet and outlet 13, and the interior of the housing 11 is provided with a blower assembly 15 and a vacuum assembly 16 and at least one group of air duct switching assembly 12 is installed on one side of the blower assembly 15 and the vacuum assembly 16. The air duct switching assembly 12 is formed by a mounting bracket 122, a pipe connector 123, a flexible hose 124 and a rotating assembly 121. A cavity 1221 is provided in the mounting bracket 122. A group or more groups of air inlet connecting port 1224 and air outlet connecting port 1225 are provided at the bottom of the cavity 1221. A hole 1226 is at the top of the cavity 1221. The hole 1226 extends to the air inlet connecting port 1224 on the bottom of cavity 1221 and the opposite sides of the air outlet connecting port 1225 on the bottom of cavity 1221. The outlet of the blower assembly 15 is transferred with the air outlet connecting port 1225 on the air duct switching assembly 12 through the pipe connector 123. The air inlet of the vacuum assembly 16 is communicated with the air inlet connecting port 1224 on the air duct switching assembly 12 through the pipe connector 123. The pipe connector 123 is glibly installed in the cavity 1221 on the mounting bracket 122. The pipe connector 123 is adapted to the cavity 1221. The pipe connector 123 includes a base plate 1231 arranged below. The housing wall of the base plate 1231 has an annular groove. And the groove is installed with a spring 1232. The spring 1232 is provided with an circular cover plate 1233, and the circular cover plate 1233 set on the base plate 1231. The two sides of the base plate 1231 is provided with two convex platforms 1234 respectively. The convex platforms 1234 extend out of the cavity 1221 outer wall. The rotating assembly 121 includes a control handle 1211 on the mounting side, which runs through the housing 11 and is rotatably connected with the housing 11. The inner side of the control handle 1211 is provided with a u-shaped bracket 1212, and the two side walls of the opening of the u-shaped bracket 1212 are provided with limited position sliding holes. The rotating assembly 121 is connected with the pipe connector 123 through the limit slip hole and the convex platforms 1234. The flexible hose 124 is installed on one side of the pipe connector 123. One end of the flexible hose 124 is connected with the pipe connector 123. The other end of flexible hose 124 passes through the hole 1226 at the top of cavity 1221 to connect with the air inlet and outlet 13. The air inlet and outlet 13 can be connected to the external hose. The flexible hose 124 is a flexible hose with deformation and malleability. At the same time, the pipe connector 123 is connected. When the pipe connector 123 moves to the air outlet connecting port 1225 on the air duct switching assembly 12, the flexible hose 124 is connected to the air outlet of the blower assembly 15, this is the blowing mode. When the pipe connector 123 moves to the air inlet connecting port 1224 on the air duct switching assembly 12, the flexible hose 124 is connected with the air inlet of the vacuum assembly 16. This is the suction mode, the device's blowing mode and suction mode are very easy to operate, and the structure is simple.

An annular groove 1222 is provided on the inner bottom surface of cavity 1221 and is located at the inlet air connection opening and outlet air connection opening. An adaptive elastic rubber cushion can also be set in the annular groove 1222 to increase air tightness. The bottom surface of the base plate 1231 is provided with an annular arc convex platforms 12312 which is matched with the annular groove 1222 in cavity 1221. When the base plate 1231 slides to the air inlet connecting port 1224 or the air outlet connecting port 1225, the annular arc convex platforms 12312 is firmly clamped into the annular groove 1222 under the elastic force of the spring 1232, so that the connection dislocation of the pipe connector 123 is effectively prevented, and the blowing/suction effect of the device 1 is influenced. In addition, the hair can be effectively prevented from being clamped into the air duct switching assembly 12 during suction, thereby reducing the failure of the air duct switching assembly 12 in use. The bottom surface of the base plate 1231 can also be designed as a flat or curved shape. The two opposite sidewalls of the mounting bracket 122 are provided with one or more groups of chute 1223. The chute 1223 on the mounting bracket 122 are matched with the convex platforms 1234 on the base plate 1231, wherein, the convex platforms 1234 on the base plate 1231 move up and down or left along with the base plate 1231, and the convex platforms 1234 on the cavity 1221 move up and down or left or right in the chute 1223 to prevent the pipe connector 123 from shaking or rotating in the cavity 1221 or the curved surface. A bottom surface portion in contact with the pipe connector 123 is fitted.

A corresponding trigger device 17 is installed above the contact piece 1213 on the u-shaped bracket 1212, and the trigger device 17 is fixed on the housing 11 through screws or fasteners. The corresponding trigger device 18 is installed below the contact piece 1214 on the u-shaped bracket 1212, and the trigger device 18 is fixed on the housing 11 through screws or fasteners. The contact piece 1213 corresponds to the trigger device 17, and the contact piece 1214 corresponds to the trigger device 18. The trigger device 17 and trigger device 18 are a kind of device to open and close the circuit, which can be set into contact switch and induction switch, and is compatible with contact piece 1213 and contact piece 1214. The device 1 also includes a circuit board 14 and a driving circuit which is compatible with the circuit board 14. The circuit board 14 is installed in the inner side of the housing 11. The blower assembly 15 comprises a motor assembly and an electric heating wire installed on the inner side of the blower assembly 15 housing; motor assembly, electric heating wire, trigger device 17 are electrically connected with the circuit board 14. Twist the control handle 1211 downward, u-shaped bracket 1212 linkage pipe connector 123 on the control handle 1211 moves downward, when the pipe connector 123 is stuck into the annular arc convex platforms 12312 on the bottom face of the base plate 1231 into the annular groove 1222 on the bottom of the cavity 1221. The contact piece 1213 on u-shaped bracket 1212 is in contact with trigger device 17. At this time, turn on the corresponding switch button on the device 1. The motor assembly in the blower assembly 15 corresponding switch button on the device 1. The motor assembly in the blower assembly 15 is energized with the electric heater to start, and blower assembly 15 blows air outward; the vacuum assembly 16 also includes a motor assembly mounted on the inside side of the vacuum assembly 16 housing and a dust cup with air filter assembly mounted in front of the motor assembly. The motor assembly and trigger device 18 are electrically connected with circuit board 14, and the control handle 1211 is twisted upward. The u-shaped bracket 1212 on the control handle 1211 is connected to the pipe connector 123. When the annular arc convex platforms 12312 on the bottom face of the base plate 1231 of the pipe connector 123 is stuck into the annular groove 1222 on the inside of the cavity 1221, the contact piece 1214 on the u-shaped bracket 1212 is in contact with the trigger device 18. At this time, turn on the corresponding switch button on the device 1, and the motor assembly in the vacuum assembly 16 is powered on. The vacuum assembly 16 draws air or dust into the dust cup.

Working of the invention: in the invention, the air duct switching assembly 12 is used in this invention. First, it connects the plug-in wire on the device 1 to the adaptive power supply, and then connect the adaptive external connection hose on the intake and outlet of the device 1. When the user needs the blowing function/suction function, simply by twisting the control handle 1211 on the rotating assembly 121 upward or downward. The u-shaped bracket 1212 rotates upward or downward, moves up or down with the convex platforms 1234 on base plate 1231 through the upper limit sliding hole 12121 of u-shaped bracket 1212, and links the pipe connector 123 at the same time. If the pipe connector 123 moves to the air outlet connection port on air duct switching assembly 12, this is the blowing mode. When the annular arc convex platforms 12312 on the bottom face of the base plate 1231 is stuck into the annular groove 1222 on the inside of the cavity 1221, the contact piece 1213 on the u-shaped bracket 1212 is in contact with the trigger device 17. At this time, turn on the corresponding switch button on the device 1. The circuit board 14 and the driving circuit compatible with circuit board 14 (the driving circuit belongs to the prior art, and will not be explained in detail here) connect the power supply of the blower assembly 15. The motor assembly in the blower assembly 15 is energized with the electric heater to start, and the blower assembly 15 blew the air outward. If the pipe connector 123 moves to the air inlet connection port on the air duct switching assembly 12. This is suction mode. When the annular arc convex platforms 12312 on the bottom face of the base plate 1231 for the pipe connector 123 is stuck into the annular groove 1222 on the bottom of the cavity 1221, the contact piece 1214 on the u-shaped bracket 1212 is in contact with the trigger device 18. At this time, turn on the corresponding switch button on the device 1. Circuit board 14 is connected to the power supply of the vacuum assembly 16. The motor in the vacuum assembly 16 is energized. The device's blowing mode and suction mode are very easy to operate, and the structure is simple.

Wherein, the air inlet connecting port 1224 of the air duct switching assembly 12 is connected to the dust cup with air filter assembly of the vacuum assembly 16 through the pipe connector 123, and dust cup with air filter assembly is used to filter and store the inhaled dust and hair.

While the invention has been described in terms of preferred embodiments, those skilled in the art will recognize that the invention can be practiced with modifications within the spirit and scope of the appended claims.

What is claimed is:

1. An air flow channel switching structure, comprising a device including a housing;

wherein a front end of the housing is provided with an air inlet and outlet;

wherein an interior of the housing is provided with a blower assembly and a vacuum assembly, one side of the blower assembly and one side of the vacuum assembly are provided with at least one group of air duct switching assembly;

wherein the at least one group of air duct switching assembly comprises a mounting bracket, a pipe connector, a flexible hose and a rotating assembly;

wherein a cavity is provided in the mounting bracket, a bottom of the cavity is provided with one or more groups of air inlet connecting ports and air outlet connecting ports, and a top of the cavity is provided with a hole, the hole extends to two opposite sides of the air inlet connecting port and the air outlet connecting port on the bottom of the cavity, the blower assembly is mutually communicated with the air outlet connecting ports on the at least one group of air duct switching assembly through the pipe connector, the vacuum assembly is mutually communicated with the air inlet connecting ports on the at least one group of air duct switching assembly through the pipe connector;

wherein the pipe connector is slidably installed in the cavity on the mounting bracket, and the pipe connector is matched with the cavity;

wherein the pipe connector comprises a base plate that is arranged below the pipe connector, wherein a spring is disposed on the base plate, a circular cover plate is arranged above the spring, and the circular cover plate is sleeved on the base plate;

wherein two sides of the base plate are provided with two convex platforms respectively, and the two convex platforms extend out of the cavity;

wherein the rotating assembly comprises a control handle arranged on one side of the rotating assembly, wherein the control handle penetrates through the housing and is rotatably connected with the housing, a u-shaped bracket is arranged on an inner side of the control handle, the u-shaped brackets is provided with two limit sliding holes respectively, the rotating assembly is connected flexibly with the pipe connector through the limit sliding holes and the two convex platforms;

wherein the flexible hose is arranged at one side of the pipe connector, one end of the flexible hose is in fit connection with the pipe connector, the other end of the flexible hose passes through a hole of the cavity and is matched and butted with the air inlet and outlet, and the air inlet and outlet can be externally connected with the flexible hose; and wherein by twisting the control handle on the rotating assembly up or down, the u-shaped bracket turns up or down while connecting the pipe connector;

wherein when the pipe connector moves to the air outlet connecting ports on the at least one group of air duct switching assembly, the flexible hose is connected to an air outlet of the blower assembly, which is a blowing mode, when the pipe connector moves to the air inlet connecting ports on the at least one group of air duct switching assembly, the flexible hose is connected with an air inlet of the vacuum assembly, which is a suction mode.

2. The air flow channel switching structure of claim 1, wherein the bottom of the cavity, an opening of the air inlet connecting ports and an opening of the air outlet connecting ports are respectively provided with an annular groove; and the annular groove can also be provided with an adaptive elastic rubber pad.

3. The air flow channel switching structure of claim 2, wherein a bottom face of the base plate is provided with annular arc convex platforms, and the annular arc convex platforms are matched with an annular groove inside the cavity, when the base plate moves to the air inlet connecting ports or air outlet connecting ports, under the elastic force of the spring, the annular arc convex platforms are stuck into the annular groove, which prevents the misalignment of the pipe connector, affecting the blowing or suction effect of the device, and prevents hair from getting stuck into the at least one group of air duct switching assembly during a suction process, a failure of the at least one group of air duct switching assembly during use is reduced, and the bottom face of the base plate is designed as a flat or curved shape.

4. The air flow channel switching structure of claim 3, wherein one side surface of the u-shaped bracket is provided with a first contact piece and a second contact piece, and the first contact piece is arranged at one side of the second contact piece.

5. The air flow channel switching structure of claim 4, wherein a first trigger device is installed above the first contact piece on the u-shaped bracket, and the first trigger device is fixed on the housing through a screw or a buckle, a second trigger device is installed below the second contact piece on the u-shaped bracket, the second trigger device is fastened to the housing through screws or snaps.

6. The air flow channel switching structure of claim 5, wherein the blower assembly includes a motor assembly and electric heating wire installed on an inner side of the housing;

the motor assembly, the electric heating wire, the first and second trigger device are electrically connected with a circuit board;

when the control handle is twisted downward, the u-shaped bracket on the control handle causes the pipe connector to move downward;

when the annular arc convex platforms on the bottom face of the base plate are stuck into the annular groove inside a lower part of the cavity; the first and second contact piece on the u-shaped bracket are in contact with the first and second trigger devices, a corresponding switch button on the device is turn ed on;

the motor assembly in the blower assembly is energized with electric heater to start, and the blower assembly blows air outward.

7. The air flow channel switching structure of claim 2, wherein a bottom surface part of the cavity can also be designed as a flat or curved shape, and the bottom surface part of the cavity is in contact with the pipe connector.

8. The air flow channel switching structure of claim 3, wherein the vacuum assembly also comprises a motor assembly arranged at one side of a housing of the vacuum assembly and a dust cup with an air filter assembly arranged in front of the motor assembly, the motor assembly and first and second trigger devices are electrically connected with a circuit board, the u-shaped bracket on the control handle is linked with the pipe connector to move upwards by twisting the control handle upwards;

when the annular arc convex platforms on a bottom surface of the base plate of the pipe connector are clamped into the annular groove above the cavity, the first and second contact pieces on the u-shaped bracket is contacted with the first and second trigger devices, a corresponding switch button on the device is turned on to make a motor assembly in the vacuum assembly be energized to work, and the vacuum assembly draws air or dust into the dust cup.

9. The air flow channel switching structure of claim 1, wherein two opposite side walls of the mounting bracket are provided with one or more groups of chutes, the one or more groups of chutes on the mounting bracket are matched with the two convex platforms on the base plate, and the two convex platforms on the base plate move up and down/leftwards along with the base plate, and move within chutes.

10. The air channel switching structure of claim 1, wherein the device further comprises a circuit board and a driving circuit matched with the circuit board, wherein the circuit board is installed at one side inside the housing.

* * * * *